US006223368B1

(12) United States Patent
Anslin

(10) Patent No.: US 6,223,368 B1
(45) Date of Patent: May 1, 2001

(54) SUPPORT DEVICE

(76) Inventor: Jyrki Anslin, Klockarvägen 22, SE-147 71 Grödinge (SE)

( * ) Notice: Subject to any disclaimer, the term of this patent is extended or adjusted under 35 U.S.C. 154(b) by 0 days.

(21) Appl. No.: 09/376,877

(22) Filed: Aug. 18, 1999

Related U.S. Application Data

(63) Continuation of application No. PCT/SE98/00289, filed on Feb. 18, 1998.

(30) Foreign Application Priority Data

Feb. 19, 1997 (SE) ..... 9700588

(51) Int. Cl.[7] ..... A61G 9/00; A61G 7/02

(52) U.S. Cl. ..... 5/630; 5/655.3; 5/695; 4/457

(58) Field of Search ..... 5/630, 632, 648, 5/652, 654, 655.3, 615, 695

(56) References Cited

U.S. PATENT DOCUMENTS

| | | | | |
|---|---|---|---|---|
| 211,741 | * | 1/1879 | Johnson | 5/630 |
| 804,750 | * | 11/1905 | Meinecke et al. | 5/655.3 X |
| 1,343,357 | * | 6/1920 | Eggers | 5/655.3 X |
| 1,981,666 | * | 11/1934 | Ridley | 5/632 |
| 2,750,600 | * | 6/1956 | MacDonald | 4/455 |
| 3,008,153 | * | 11/1961 | Coulfer | 5/654 |
| 3,331,087 | * | 7/1967 | Barlow | 5/655.3 X |
| 3,609,771 | * | 10/1971 | Avoy | 4/451 |
| 3,728,744 | * | 4/1973 | Kimbro, Jr. et al. | 5/648 X |
| 3,729,749 | * | 5/1973 | Rosecrans | 4/452 |
| 3,935,604 | * | 2/1976 | Collins | 5/630 |
| 4,207,633 | * | 6/1980 | Smith et al. | 5/632 |
| 4,947,493 | * | 8/1990 | Salonica | 4/465 X |
| 4,949,409 | * | 8/1990 | Stefano | 5/695 X |
| 4,977,629 | * | 12/1990 | Jones | 5/695 X |
| 4,998,301 | * | 3/1991 | Markus | 5/655.3 X |
| 5,081,721 | * | 1/1992 | Stefano | 5/695 X |
| 5,193,232 | * | 3/1993 | Flood et al. | 4/457 |
| 5,522,103 | * | 6/1996 | Kier et al. | 5/630 |

FOREIGN PATENT DOCUMENTS

| | | | | |
|---|---|---|---|---|
| 562 030 | | 3/1974 | (CH) . | |
| 1922670 | * | 11/1970 | (DE) | 5/655.3 |
| 2 656 795 | | 7/1991 | (FR) . | |
| 4334 | * | of 1874 | (GB) | 5/652 |

* cited by examiner

*Primary Examiner*—Terry Lee Melius
*Assistant Examiner*—Robert G. Santos
(74) *Attorney, Agent, or Firm*—Thomas R. Vigil

(57) ABSTRACT

A support device provided to be arranged on a base member (1) such as a mattress, a bunk or a bed, and comprising an inflatable portion (2) which is arranged to be in an inflated state in order to lift a person resting upon the inflatable portion (2), the inflatable portion (2) comprising an inlet opening (5) and an outlet opening (6) for the supply and evacuation respectively of an inflation medium. The inflatable portion (2) comprises a lateral projection (4) provided to project beyond a lateral edge (3) of the base member (1) and at which the inlet opening (5) and the outlet opening (6) are arranged.

15 Claims, 1 Drawing Sheet

SUPPORT DEVICE

This applicatiion is a continuation of international application number PCT SE 98/00289, filed Feb. 18, 1998.

THE BACKGROUND OF THE INVENTION AND PRIOR ART

The present invention relates to a support device provided to be arranged onto a base member such as a mattress, a bunk or a bed, and comprising an inflatable portion provided to be in an inflated state in order to lift a person resting upon the inflatable portion, the inflatable portion comprising at least one opening for the supply and evacuation of an inflation medium.

According to prior art, a plurality of such support devices are known, these particularly being arranged to permit the insertion of a bowl or the like below a person resting on the support device in order to permit said person to relieve himself or herself by means of said bowl while being supported by the inflatable portion on which the person may lay or sit. In particular, such devices are provided to be used in the medical service where the persons being treated often have substantial difficulties in moving themselves in order to relieve themselves, and where, accordingly, it is up to the personnel to move and position such patients, which are often bound to their beds, in order to make them able to relieve themselves in a bowl, a so called basin, which in turn is positioned on the bed. Prior support devices, such as for instance the one disclosed in FR 2 656 795 or FR 2 168 759, comprises a recess in the inflatable portion, into which the recess the bowl, that is the basin, may be brought into a position below a person resting on the inflatable portion and lifted by the latter as it is in its inflated state. Thereby, an important advantage is obtained, as the personnel is relieved from heavy lift operations that would otherwise be necessary in order to position persons or patients correctly on the basin. Moreover, the inflatable portion gives a comfortable support to the patient as the latter is laying or sitting on the basin and is to relieve himself or herself. This aspect is also important in order to provide for the physical and psychological health of the patient.

When the inflatable portion is in its evacuated state, it is requested that the support device is positioned as plane and flat as possible along the surface of the base member, in order to avoid the person or the patient from experiencing any discomfort due to the presence of the support device. Support devices according to prior art take this into consideration by being formed by relatively thin layers of a material that enables them to better follow the outer shape presented by the base member as the patient takes different positions thereon. This is for instance disclosed in the documents WO 91/07938, U.S. Pat. No. 5,193,232 and the above French documents.

However, prior art does not take into consideration the substantial unevenness caused by the inlet and outlet openings respectively and valves possibly arranged at said openings. Accordingly, by support devices according to prior art, there are inlet and outlet openings with their possible valves arranged on the inflatable portion in such a way that they are present on the base member upon which the patient or person in question is resting. Thereby, the patient may lay upon these unevennesses, which might me found uncomfortable by patients in general and which might be harmful to patients that are disabled or have tendencies towards bedsores.

SUMMERY OF THE INVENTION

One object of the present invention is to provide a support device which, in an inflated state, fully or partly lifts a person resting thereupon and which forms a surface which is generally free from unevennesses which would cause discomfort or hurt a person resting thereupon as the support device is positioned onto a base member such as a mattress, a bunk or a bed. Another object of the invention is to provide a cheap and functional alternative to support devices of prior art. This object is obtained by a support device of the type initially defined, which is characterized in that the inflatable portion comprises a lateral projection provided to project beyond a lateral edge of the base member and at which said opening is arranged.

According to a preferred embodiment of the inventive support device, the inflatable portion comprises a recess and support surfaces for the person, arranged around the recess, said recess being arranged to permit the insertion of a bowl-shaped element into it below the person as the inflatable portion is in its inflated state.

Thereby the maintenance of the hygiene of a person resting on the support device is substantially facilitated in the case where said person is totally or partly unable of moving himself or herself, which is often the case for patients taken care of by the medical service. Hereby, one assisting person is enough in order to position the patient above the bowl-shaped element, or so called basin, into which the patient is to relieve himself or herself, which is an advantage. Also afterwards, when the bowl-shaped element has been removed from its operative position, the embodiment is advantageous in that a cleaning of the patient may take place through the recess, and the patient does not need to be further moved in order to be cleaned.

According to another preferred embodiment of the device according to the invention, said opening is connected to a source for the inflation medium via a conduit, and comprises a joint member in order to be released from the source of the inflation medium. Moreover, the conduit comprises a valve member which is arranged somewhere along the part of the conduit that extends from the region of the opening to the joint member.

Thereby, a particular advantage is obtained as a decoppling of the support device from the inflation medium may take place after the inflatable portion has been brought to its inflated state, and as the base member, often constituted by a bed with wheels in a hospital, may be removed from the source of the inflation medium while, at the same time, the inflated state is maintained.

According to another preferred embodiment of the device according to the invention, said device comprises an evacuation valve, arranged at said opening. The evacuation valve comprises an overpressure regulator, provided to open the valve as the pressure in the inflatable portion reaches a predetermined value.

Thereby, particularly the risk of obtaining to high pressure in the inflatable portion during the inflation thereof is avoided. A too high pressure will otherwise, in the worst case, result in a bursting of the inflatable portion, which, of course, is not desirable. Thanks to the evacuation valve being arranged at the lateral projection, the valve may be of significant dimension, which may be advantageous when a rapid evacuation is requested.

According to another embodiment of the device according to the invention, said device comprises means for attaching the inflatable portion to the base member.

Thereby, there is a guaranty that the person resting on the support device obtains a relatively stable support while being lifted by the support device as the latter is in its inflated state. This aspect is important to the person in question as well as for the assisting personnel, in order to make it easy for the latter to take the required measures as the person in question, that is the patient, is to relieve himself or herself by using the inventive device.

According to another preferred embodiment of the device according to the invention, the attachment means are arranged to extend around the base member, and they comprise at least one band that extends around the base member and is connected to the inflatable portion. Thereby, a very good and reliable attachment of the inflatable portion is obtained, in contrast to those cases when one tries to accomplish an attachment only by applying a friction material between the inflatable portion and the base member or when one only tries to obtain an attachment by means of flaps or the like projecting from the inflatable portion by folding the latter under the base member. Moreover, the attachment means of the invention permit a good hold of a sheet positioned thereunder on the base member.

According to another preferred embodiment of the inventive device, it also comprises a cover layer provided to extend between the inflatable portion and the base member and to which the inflatable portion is connected. The cover layer and the attachment means form a continuous layer to which the inflatable portion is attached.

Thereby, a very simple construction is obtained, which, in principle, is only comprised by the inflatable portion and a band or a surface onto which it is attached.

According to yet a preferred embodiment of the inventive device, the inflatable portion comprises an upper and lower layer, connected to each other generally along their respective periphery.

Surprisingly, such a very simple construction appears to be enough in order to accomplish those shapes that are desired for the inflatable portion in its evacuated state as well as in its inflated state. The consumption of material for the manufacture of the inflatable portion becomes minimal, as well as the total seam length required for the joining of this portion. The maximum thickness of the portion in the evacuated state may also be minimized as thee are only two layers needed.

According to yet another preferred embodiment of the inventive device, the inflatable portion is connected to the cover layer only along parts of its periphery.

Thereby, particularly problems of wrinkling, which otherwise tend to be appearing by the cover layer and/or the inflatable portion due to the dimensional variations appearing in connection to the inflation and evacuation of the inflatable portion, is remedied.

Further features and advantages of the support device according to the invention will be evident from the following description and from the rest of the dependent patent claims.

BRIEF DESCRIPTION OF THE DRAWINGS

By way of example, but not in order to delimit it, the support device according to the invention will now be described more in detail with reference to the annexed drawings, in which.

DETAILED DESCRIPTION OF AN EMBODIMENT

Figure 1:
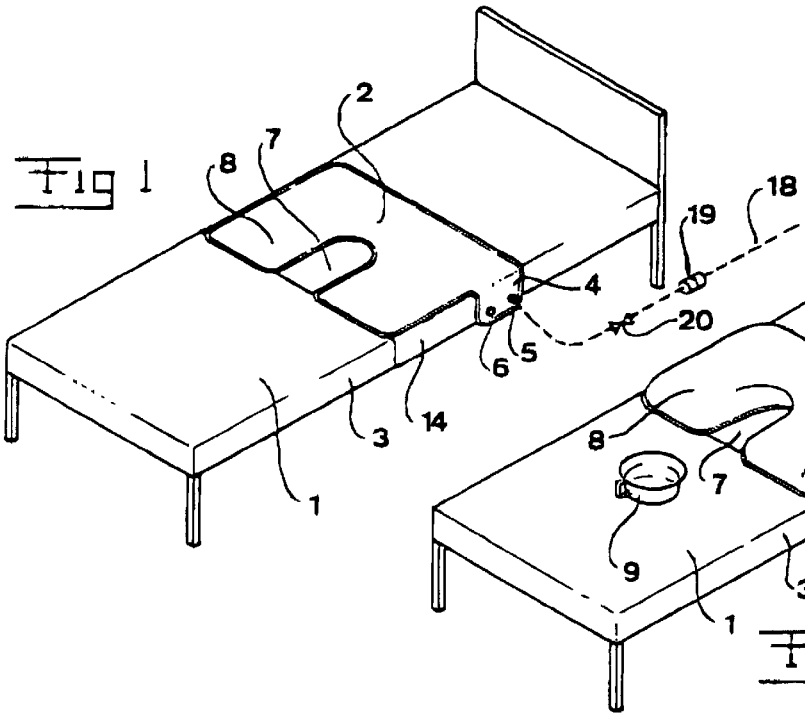
FIG. 1 is a perspective view of the support device as arranged on a bed.

In the figures, an embodiment of the support device according to the invention is shown, said device being provided to be arranged on a base member 1, which might be a mattress, a bunk or, as in this case, a bed. The support device comprises an inflatable portion 2, provided to be in an inflated state in order to lift a person resting on the inflatable portion 2.

The inflatable portion 2 is provided to extend to at least one lateral edge 3 of the base member 1. At this end of the inflatable portion, it comprises a lateral projection 4 provided to project beyond the lateral edge 3 of the base member 1 and at which an inlet opening 5 and an outlet opening 6 are arranged. The lateral projection 4 extends, amongst other, from considerations of space, only along a part of the end or side of the inflatable portion 2 from which it projects. However, it could as well be arranged along a greater part or along all of this side.

Figure 2:
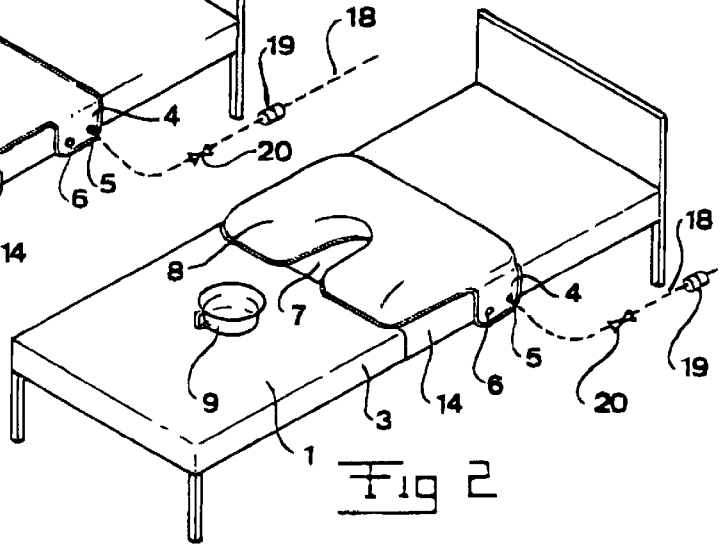
FIG. 2 is a perspective view corresponding to FIG. 1, but with the inflatable portion of the device in an inflated state.
Figure 3:
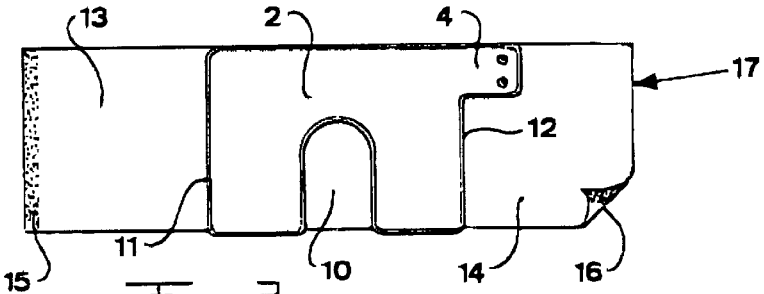
FIG. 3 is a view from above of the support device according to the invention.
Figure 4:
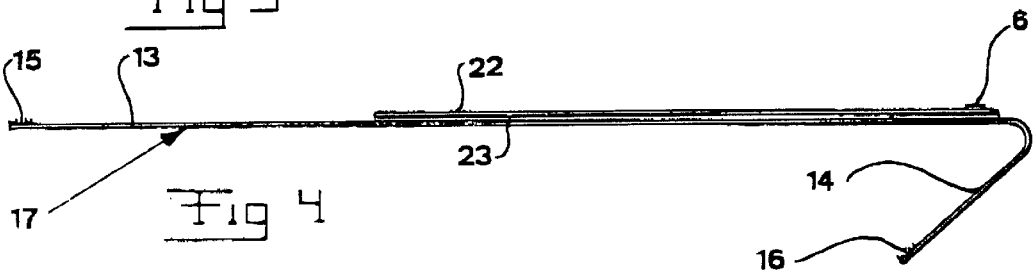
FIG. 4 is a sectional view of the support device.
Figure 5:
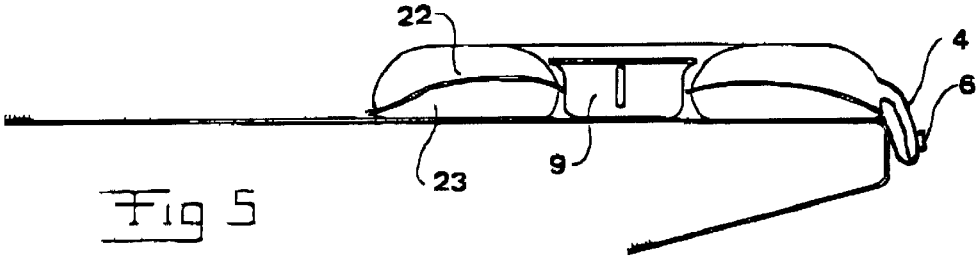
FIG. 5 is a view according to FIG. 4, but with the inflatable portion in an inflated state.

In practice, the lateral projection 4 forms a part of the inflatable portion 2 and is, likewise the latter, inflatable. In the evacuated state the lateral projection 4 will, as can be seen in FIG. 2, hang down over the lateral edge 3 of the base member 1. Thereby, it is avoided that a person resting on the support device will run the risk of lying on the unevennesses formed in the region of the inlet opening 5 and the outlet opening 6. In its inflated state, the lateral projection 4 will project out form the lateral edge 3 of the base member 1 more than in its evacuated state.

Moreover, the inflatable portion 2 comprises a recess 7 and support surfaces 8 provided around the recess 7 for the person resting thereupon, the recess 7 being arranged to permit an insertion therein of a bowl-shaped element 9 beneath the person by the inflated state of the inflatable portion 2. The recess 7 extends from one side of the inflatable portion 2 and forms a lateral recess. The bowl-shaped element 9 may be a so called basin of the type used in the medical service. Moreover, in the medical service, a so called pull sheet is normally used, said sheet extending over the support device and being stretched around the base member 1. In connection to the inflation of the inflatable portion 2, the pull sheet is loosened in order to permit the inflation of the portion 2, and it is pressed down into the recess 7 in order to permit the positioning therein of the bowl-shaped element 9.

Along two opposite ends or sides of the inflatable portion 2 the latter is connected to a cover layer 10 arranged to spread between the base member 1 and the inflatable portion 2. The ends 11, 12 along which the joint between the cover layer 10 and the inflatable portion 2 extends run in a direction of the support device which is supposed to be generally parallel to the lengthwise direction of the base member. From the region of these ends 11, 12, attachment means 13, 14 provided to be stretched around the base member 1 in order to fix the support device in relation to the base member extend. The attachment means 13, 14 are provided with attachment members 15, 16 in order to be connected to each other while at the same time forming a loop running around the base member 1. The attachment members 15, 16 suitably comprise a Velcro connection.

In the embodiment shown, the cover layer 10 and the attachment means 13, 14 are formed by a band or carpet onto which, accordingly, the inflatable portion 2 is to be attached by means of joints extending generally perpendicularly to the lengthwise direction of the carpet, that is along the ends 11, 12. Here, the inflatable portion 2 is positioned at the middle of the length of the carpet 17, but it could as well be arranged in the region of any of the ends thereof. The inflatable portion 2 extends generally over the total width of the carpet 17. This construction has the particular advantage of being very simple while at the same time guaranteeing a very stable support for a person resting thereon by the inflated state, and not being found discomfortable or irritating to lay upon when being in its evacuated state. The inflatable portion 2 as well as the cover layer 10 and the attachment means 13, 14 are made of flexible material, here a polymer material. The inflatable portion 2 and the lateral projection 4 comprises an upper layer 22 and a lower layer 23 of generally identical shape, said layers overlapping each other and being connected to each other through a joint, e.g. a glue joint, running along their respective outer periphery.

Moreover, the inflatable portion is connected to an inflation medium source (not shown) via a conduit 18. The conduit 18 is connected to the inlet opening 5 end permits the inflation medium to flow from the source into the inflatable portion 2. The conduit 18 also comprises a joint member 19 in order to be released from the source of the inflation medium. Moreover, the device comprises a valved member 20 formed by a non return valve arranged in the conduit 18 somewhere along the part of the conduit that extends from the region of the inlet opening 5 to the joint member 19.

The device also comprises an evacuation valve (not shown) arranged in connection to the outlet opening 6. The evacuation valve comprises an overpressure regulator, arranged to open the valve as the pressure in the inflatable portion 2 reaches a predetermined value. It also comprises means (not shown) for the manual opening thereof.

Of course, a plurality of modifications and variants of the inventive support device will be obvious to a man skilled in the art without thereby going beyond the scope of the invention.

For example, the device may be dimensioned so as the extend over a large or smaller part of the length of the base member. When the base member is formed by a bed divided into three portions in its lengthwise direction, as is often the case in the medical service, a support device preferably has such a length that it only spreads over one of these portions, preferably the intermediate portion.

What is claimed is:

1. A support device constructed and arranged to be supported on a base member (1) such as a mattress, bunk or bed and comprising an inflatable portion (2) having two side ends, and constructed and arranged, in an inflatable state, to lift and support a person resting on said inflatable portion, at least one opening (5, 6) for the supply and evacuation of an inflation medium to said inflatable portion, a lateral, inflatable portion (4) constructed and arranged to extend beyond a lateral edge (3) of the base member (1) without providing any support to a person resting on said inflatable portion, said lateral inflatable portion, in said inflated state, projecting beyond one of said ends of said inflatable portion (2) and arranged to project beyond the lateral edge (3) of the base member (1) and along the lateral edge of the base member and said opening (5, 6) being arranged in said lateral inflatable portion (4) to permit inflation of both said inflatable portion and said lateral inflatable portion at a location outwardly of the lateral edge of the base member.

2. A support device according to claim 1, characterized in that the inflatable portion (2) has recess (7) and support surfaces for the person, arranged around the recess (7), the recess being arranged to permit the insertion into it of a bowl-shaped element (9) under the person, when the inflatable portion (2) is in the inflated state.

3. A support device according to claim 1, characterized in that said opening (5, 6) comprises an inlet opening (5) which is connected to a source for the inflation medium, via a conduit (18).

4. A support device according to claim 3, characterized in that the conduit (18) comprises a joint member (19) in an order to be released from the source of the inflation medium.

5. A support device according to claim 3, characterized in that the conduit (18) comprises a valve member (20).

6. A support device according to claim 5 characterized in that said valve member (20) is arranged along the part of the conduit (18) that extends from the region of the inlet opening (5) to the joint member (19).

7. A support device according to claim 1, characterized in that it comprises an evacuation valve (21) which is arranged at said opening (6).

8. A support device according to claim 7, characterized in that the evacuation valve (21) is constructed and arranged to be operated when the pressure in the inflatable portion (2) reaches a predetermined value.

9. A support device according to claim 1, characterized by comprising generally flat attachment means (13, 14) fixed to said inflatable portion (2) for the attachment of said inflatable portion (2) to the base member (1).

10. A support device according to claim 9, characterized in that said attachment means (13, 14) are arranged to extend around the base member (1).

11. A support device according to claim 9, characterized in that said attachment means (13, 14) comprise at least one band (17) which is arranged to extend around the base member (1) and which is connected to said inflatable portion (2).

12. A support device according to claim 1, characterized by comprising a cover layer (10) constructed and arranged to extend between the inflatable portion (2) and the base member (1) and said inflatable portion (2) being connected to said cover layer.

13. A support device according to claim 12, characterized by further comprising attachment means (13, 14) for attaching said inflatable portion (2) to the base member (1) and said cover layer (10) and said attachment means (13, 14) form a continuous layer (17).

14. A support device according to claim 1, characterized in that the inflatable portion (2) comprises an upper and a lower layer (22, 23) connected to each other generally along their respective periphery.

15. A support device according to claim 12 characterized in that said inflatable portion (2) is connected to the cover layer (10) only along certain parts of a periphery of said inflatable portion.

* * * * *